US008552290B2

(12) United States Patent
Debladis et al.

(10) Patent No.: US 8,552,290 B2
(45) Date of Patent: Oct. 8, 2013

(54) STRAND HAVING A LIMITED SPRING EFFECT

(75) Inventors: Francis Debladis, Sainte Catherine les Arras (FR); Stephane Morice, Leforest (FR); Emilien Comoret, Paris (FR)

(73) Assignee: Nexans, Paris (FR)

( * ) Notice: Subject to any disclaimer, the term of this patent is extended or adjusted under 35 U.S.C. 154(b) by 268 days.

(21) Appl. No.: 12/573,212

(22) Filed: Oct. 5, 2009

(65) Prior Publication Data

US 2010/0252301 A1 Oct. 7, 2010

(30) Foreign Application Priority Data

Oct. 16, 2008 (FR) ..... 08 57021

(51) Int. Cl.
*H01B 7/00* (2006.01)

(52) U.S. Cl.
USPC ..... 174/36

(58) Field of Classification Search
USPC ..... 174/36, 126.1, 126.2
See application file for complete search history.

(56) References Cited

U.S. PATENT DOCUMENTS

| | | | | |
|---|---|---|---|---|
| 4,233,067 | A * | 11/1980 | Sawada | 420/494 |
| 7,544,886 | B2 * | 6/2009 | Detian et al. | 174/36 |
| 2002/0066503 | A1 * | 6/2002 | Matsui et al. | 148/432 |
| 2003/0037957 | A1 * | 2/2003 | Ueno et al. | 174/128.1 |
| 2004/0187977 | A1 * | 9/2004 | Matsui et al. | 148/553 |

FOREIGN PATENT DOCUMENTS

| | | | |
|---|---|---|---|
| JP | 58-177430 | A * | 10/1983 |
| JP | 58177430 | | 10/1983 |
| JP | 2001-234309 | A * | 8/2001 |

OTHER PUBLICATIONS

Preliminary Report dated Jul. 21, 2009.

* cited by examiner

*Primary Examiner* — William H Mayo, III
(74) *Attorney, Agent, or Firm* — Sofer & Haroun, LLP

(57) ABSTRACT

A strand of section of no more than 0.35 $mm^2$ is provided having one or more electrical conductor wires, where each electrical conductor wire is constituted by an alloy of copper and tin. The tin content is not less than 1500 ppm and not more than 2500 ppm the oxygen content is not more than 400 ppm the inevitable impurities content is not more than 100 ppm and the balance of the content of the alloy is copper with the electrical conductor wire(s) being exempt from heat treatment during fabrication of the strand.

13 Claims, 1 Drawing Sheet

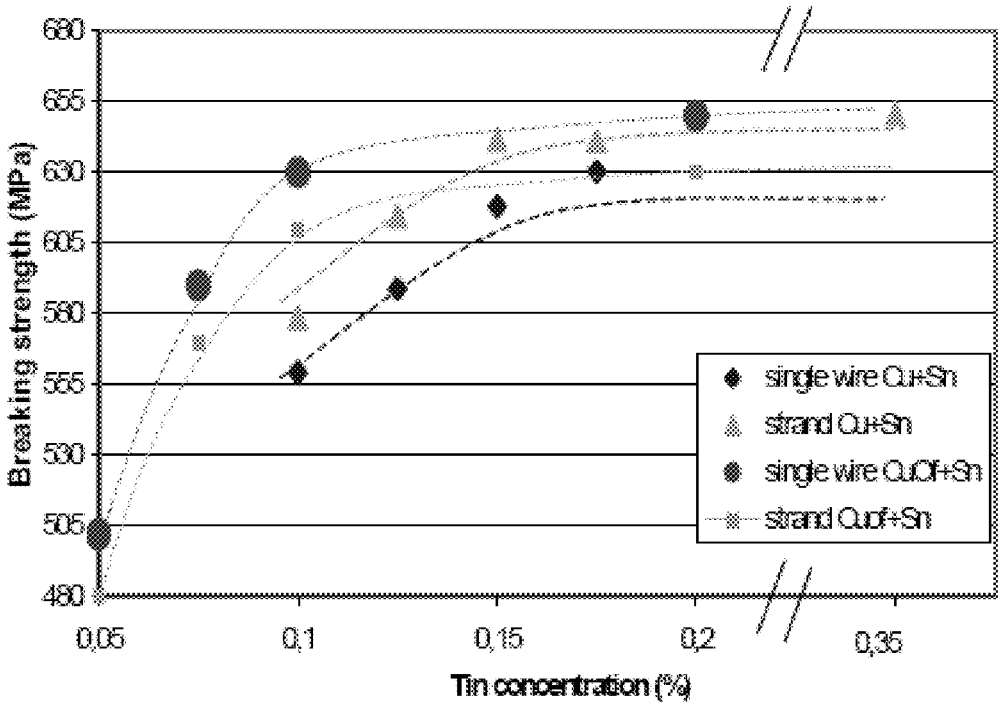
680
655
630
605
580
555
530
505
480
Breaking strength (MPa)
0,05
0,1
0,15
0,2
0,35
Tin concentration (%)
single wire Cu+Sn
strand Cu+Sn
single wire CuOf+Sn
strand CuOf+Sn

STRAND HAVING A LIMITED SPRING EFFECT

RELATED APPLICATION

This application claims the benefit of priority from French Patent Application No. 08 57021, filed on Oct. 16, 2008, the entirety of which is incorporated by reference.

FIELD OF THE INVENTION

The present invention relates to a strand comprising one or more electrical conductor wires, to an electric cable, and also to a cabling bundle.

BACKGROUND OF THE INVENTION

The invention applies typically, but not exclusively, to electric control cables or to power cables used for conveying electricity. Such cables are conventionally made up of a plurality of electrical conductor wires (or strands) of copper. The wires are twisted together to form a twisted strand of cross-section of no more than 0.5 square millimeters ($mm^2$), and the twisted strand is surrounded by an insulating sheath, e.g. obtained by extrusion.

Such cables are used in various fields in industry, such as in the automotive industry, where they are assembled into bundles for electrically powering various pieces of equipment. The cables thus need to be as light as possible in weight, and to be compact, while nevertheless conserving good mechanical strength.

In attempting to replace annealed copper strands by hard copper alloy strands in order to improve the mechanical behavior of the twisted strand made therefrom, it has been found that said copper alloy strands are difficult to handle during twisting because of a "spring" effect presented by said electrical conductor wires.

OBJECT AND SUMMARY OF THE INVENTION

The object of the present invention is to mitigate the drawbacks of prior art techniques by proposing a strand of cross-section of no more than 0.35 $mm^2$ comprising one or more electrical conductor wires (A), wherein each electrical conductor wire is constituted by an alloy of copper and tin comprising:

- a tin content of not less than 1500 parts per million (ppm) (0.15% by weight) and not more than 2500 ppm (0.25% by weight);
- an oxygen content of not more than 900 ppm (0.04% by weight);
- an inevitable impurities content of not more than 100 ppm (0.01% by weight); and
- the balance of the content of said alloy being copper;
- the electrical conductor wire(s) being exempt from heat treatment during fabrication of the strand.

The invention also provides a strand of cross-section of no more than 0.35 $mm^2$ comprising one or more electrical conductor wires (B), wherein each electrical conductor wire is constituted by an alloy of copper and tin comprising:

- a tin content of not less than 700 ppm (0.07% by weight) and not more than 1200 ppm (0.12% by weight);
- an oxygen content of not greater than 50 ppm (0.005% by weight), and preferably not greater than 5 ppm (0.0005% by weight);
- an inevitable impurities content of not more than 100 ppm (0.01% by weight); and
- the balance of the content of said alloy being copper;
- the electrical conductor wire(s) being exempt from heat treatment during fabrication of the strand.

The copper used for fabricating the alloy for electrical conductor wires B is commonly known as CuOF which is short for copper that is "oxygen free".

It has been found that the two types of wire A and B of the invention, and thus the resulting twisted strands made therefrom, present a spring effect that is significantly limited while guaranteeing satisfactory mechanical behavior.

At a tin content greater than 2500 ppm (0.25% by weight) for the electrical conductor wire A, or at a tin content greater than 1200 ppm (0.12% by weight) for the electrical conductor wire B, the spring effect of the electrical conductor wire becomes large and it is very difficult and awkward to manipulate.

At a tin content of below 1500 ppm (0.15% by weight) for the electrical conductor wire A, or at a tin content of below 700 ppm (0.07% by weight) for the electrical conductor wire B, the mechanical behavior, such as traction strength, diminishes significantly, and as a result the electrical conductor wire tends to break much more easily.

In addition, the electrical conductor wire A or B of the invention, and thus the respective twisted strands that result therefrom, advantageously presents improved 180° flexing behavior, thereby limiting any risk of the wire breaking during operations involving manipulation, assembly, transport, installation, or use.

Finally, the electrical conductor wire A or B of the invention, and thus the respective twisted strands that result therefrom, presents very good electrical conductivity (international annealed copper standard (IACS)) at ambient temperature, which electrical conductivity may be of the order of 90%.

The abbreviation ppm in the present description means "parts per million" by weight. In other words, the quantity x (or the content x) in ppm of an element z is expressed relative to the total weight of the alloy.

The term "inevitable impurities" designates all of the metallic and non-metallic elements included in the alloy during fabrication thereof, other than copper, tin, and oxygen. By way of example, these impurities may be constituted by the following elements: Ag, As, Bi, Fe, Pb, S, Sb, Se, Te, Cd, Cr, Mn, P, Ni, Co, S, Fe, and/or Zn.

The term "heat treatment during fabrication of the strand" designates any conventional heat treatment that makes it possible to obtain an annealed state for the electrical conductor wire(s). This treatment should be distinguished from structural changes associated in particular with thermal aging while the strands are in use after fabrication.

Typically, annealing heat treatment causes the microstructure of the alloy making up the electrical conductor wire(s) to be rearranged, in particular it causes the grains of copper making up the alloy to present a size that is increased after annealing. Under such circumstances, heat treatment during the fabrication of a strand inevitably induces a reduction in the mechanical strength of the alloy constituting the electrical conductor wire(s).

When the strand comprises a plurality of electrical conductor wires, the conductor wires are twisted together. When the strand comprises a single electrical conductor wire, the single wire is not twisted.

The diameter of the electrical conductor wire(s) making up the strand preferably lies in the range 0.10 millimeters (mm) to 0.67 mm.

In a preferred embodiment, the strand of the invention is advantageously not circularly compressed.

In the alloy of the invention, whether electrical conductor wire A or electrical conductor wire B, the content of inevitable impurities or the sum of the inevitable impurities may not exceed 65 ppm.

In the embodiment using electrical conductor wire A, the tin content may be strictly greater than 1500 ppm (0.15% by weight), and preferably at least 1700 ppm (0.17% by weight). The tin content may also be no greater than 2200 ppm (0.22% by weight).

The oxygen content may be no greater than 300 ppm (0.03% by weight). Preferably, the oxygen content is at least 100 ppm, and more preferably at least 150 ppm (0.015% by weight).

In the embodiment using electrical conductor wire B, the tin content may be no more than 1000 ppm (0.1% by weight). Preferably, the tin content is at least 800 ppm (0.08% by weight).

In a particularly preferred embodiment, each electrical conductor wire is tinned, i.e. it is covered in a fine metallic layer of tin on its surface. Tinning serves in particular to improve the solderability of the electrical conductor wires.

The invention also provides an electric cable including a strand having one or more electrical conductor wires A or B extending in the longitudinal direction of the cable, said strand being surrounded along the cable by an insulating sheath.

The invention also provides a cabling bundle including a plurality of electric cables as defined above.

BRIEF DESCRIPTION OF THE DRAWING

Other characteristics and advantages of the present invention appear in the light of the following examples with reference to the sole FIGURE, said examples and FIGURE being given by way of non-limiting illustration.

FIG. 1 shows the breaking strength in traction plotted as megapascals (MPa) as a function of the tin concentration (% by weight) respectively in a Cu/Sn and a CuOF/Sn alloy in the form of an electrical conductor wire and in the form of a strand of seven electrical conductor wires.

DETAILED DESCRIPTION

Examples

Method of Fabricating Electrical Conductor Wires A and B

The electrical conductor wires of the invention are conventionally fabricated by casting copper and tin, the casting subsequently being rolled on the same production line.

Unlike the fabrication of electrical conductor wires A, the casting step for fabricating the electrical conductor wires B is performed in a vacuum.

The resulting bar of copper/tin alloy is wire-drawn by a cold drawing operation serving to transform the metal bar into electrical conductor wires by successive passes through dies of smaller and smaller diameters. Since the diameter of the bar produced by rolling is large, in particular of the order of 6 mm to 10 mm, the reduction in section generally takes place in two successive wire-drawing operations. The first wire-drawing machine enables the diameter of the wire to be reduced to a value of 2.5 mm to 1.6 mm. The second wire-drawing machine enables the wire to be reduced to its final diameter, i.e. in the range 0.10 mm to 0.67 mm. Before passing to the second machine, it is possible to tin the electrical conductor wire, i.e. to deposit a fine layer of tin onto the surface of said wire by electro-plating.

At the end of wire-drawing, no annealing operation is performed and the resulting alloy thus remains in the work-hardened state.

After the wire-drawing step, the resulting electrical conductor wires are twisted together in order to obtain a twisted strand.

In an additional step, said strand may be surrounded by an insulating sheath of the electrically-insulating polymer layer type.

The alloys obtained are described in detail in Table 1 below.

TABLE 1

| | Electrical conductor wire | | | |
|---|---|---|---|---|
| | Cu/Sn alloy | | CuOF/Sn alloy | |
| | A1 | A2 | B1 | B2 |
| Tin content | 1700 | 4500 | 1000 | 2500 |
| Oxygen content | 250 | 250 | <5 | <5 |
| Impurity content | <65 | <65 | <65 | <65 |

The contents of metallic elements in the copper/tin alloys (Cu/Sn or CuOF/Sn) are conventionally determined using a spectrograph as sold by the supplier ARL under the reference Thermo Optec 3460.

The oxygen content of the alloys is conventionally determined with the help of an oxygen analyzer sold by the supplier LECO under the reference R0116.

Flexibility Test

This is a test to assess the mechanical memory of a conductor, i.e. its stiffness.

The mode of operation consists in starting with a twisted strand of seven electrical conductor wires drawn to a unit diameter of 0.202 mm and then in:

making a spring with touching turns on a mandrel having a diameter of 20 mm and under an axial stress (weight) of about 400 grams (g);

relaxing the spring by eliminating the axial stress;

cutting the spring longitudinally; and on the cut turns, measuring the relaxed diameter and the offset of a turn expressed in millimeters.

The results of this test are given in Tables 2 and 3 below.

In Tables 2 and 3, the relaxation as a percentage (%) is defined by the following formula:

$$\frac{\text{Relaxed diameter} - \text{Winding diameter}}{\text{Winding diameter}} \times 100$$

where the winding diameter is the diameter of the mandrel, i.e. 20 mm.

TABLE 2

| | Strands of seven twisted electrical conductor wires | | | |
|---|---|---|---|---|
| | Cu/Sn alloy A1 | | Cu/Sn alloy A2 | |
| | Relaxation (%) | Offset (mm) | Relaxation (%) | Offset (mm) |
| Test 1 | 1.4 | 15 | 2.0 | 8 |
| Test 2 | 1.3 | 6 | 2.1 | 28 |

TABLE 2-continued

| | Strands of seven twisted electrical conductor wires | | | |
|---|---|---|---|---|
| | Cu/Sn alloy A1 | | Cu/Sn alloy A2 | |
| | Relaxation (%) | Offset (mm) | Relaxation (%) | Offset (mm) |
| Test 3 | 1.3 | 11 | 2.0 | 32 |
| Test 4 | 1.3 | 4 | 2.4 | 34 |
| Test 5 | 1.4 | 17 | 2.2 | 15 |
| Test 6 | 1.3 | 12 | 2.0 | 25 |
| Test 7 | 1.4 | 5 | 2.1 | 10 |
| Test 8 | 1.3 | 14 | 2.0 | 12 |
| Test 9 | 1.2 | 22 | 2.0 | 24 |
| Test 10 | 1.4 | 15 | 2.0 | 22 |
| Number average over the 10 tests | 1.3 | 12 | 2.1 | 21 |

TABLE 3

| | Strands of seven twisted electrical conductor wires | | | |
|---|---|---|---|---|
| | CuOF/Sn alloy B1 | | CuOF/Sn alloy B2 | |
| | Relaxation (%) | Offset (mm) | Relaxation (%) | Offset (mm) |
| Test 1 | 1.4 | 14 | 1.9 | 16 |
| Test 2 | 1.2 | 9 | 2.1 | 19 |
| Test 3 | 1.2 | 13 | 2.0 | 22 |
| Test 4 | 1.3 | 15 | 2.0 | 17 |
| Test 5 | 1.2 | 17 | 2.1 | 26 |
| Test 6 | 1.3 | 11 | 1.8 | 24 |
| Test 7 | 1.2 | 7 | 1.9 | 19 |
| Test 8 | 1.3 | 10 | 2.0 | 22 |
| Test 9 | 1.3 | 7 | 2.0 | 17 |
| Test 10 | 1.4 | 8 | 1.9 | 17 |
| Number average over the 10 tests | 1.3 | 11 | 2.0 | 20 |

The results of Tables 2 and 3 show clearly that the strands constituted by electrical conductor wires of the invention (Cu/Sn alloy A1 or CuOF/Sn alloy B1) present relaxation and offset that are much smaller than do strands made up of prior art conductor wires (Cu/Sn alloy A2 or CuOF/Sn alloy B2). Thus, the spring effect of strands of the present invention is much less marked than that of strands of the prior art.

180° Flexing Behavior

This is a rapid test of repeated folding over a folding radius substantially equal to zero. Flexing consists in folding an electrical conductor wire through 180° and then returning it to its initial position.

The test is applicable to a range of electrical conductor wires having diameters lying in the range about 0.15 mm to about 0.51 mm. For the test, drawn electrical conductor wires with a diameter of 0.202 mm were used.

For this purpose, the first end of a portion of electrical conductor wire was fastened to a rigid stick having two parallel longitudinal faces and two longitudinal edges. The stick was secured to a handle for causing the stick to turn about its longitudinal axis.

The second end of said portion was fastened to an axial load (weight) of 85 g enabling the electrical conductor wire to be kept permanently in contact with the stick during the test.

The operating protocol of the 180° flexing test consisted in turning the handle through 180° so that the electrical conductor wire wound around the stick while remaining in contact with both main faces, and also with one of the longitudinal edge faces of the stick. Stopping the stick made it possible to fold the electrical conductor wire through 180° by virtue of the weight suspended from the second end of said wire. Thereafter the electrical conductor wire as folded in that way was unfolded. That protocol was repeated on the same portion of flexed wire until the wire broke.

The results of the test are summed up in Tables 4 and 5 below.

TABLE 4

| | Electrical conductor wire | |
|---|---|---|
| | Cu/Sn alloy A1 | Cu/Sn alloy A2 |
| | Number of go-and-return 180° folds before the wire broke | |
| Test 1 | 10 | 6 |
| Test 2 | 8 | 6 |
| Test 3 | 10 | 6 |
| Test 4 | 8 | 7 |
| Test 5 | 9 | 6 |
| Test 6 | 9 | 6 |
| Test 7 | 8 | 7 |
| Test 8 | 7 | 6 |
| Test 9 | 7 | 6 |
| Test 10 | 7 | 7 |
| Test 11 | 10 | 6 |
| Test 12 | 8 | 6 |
| Number average over the 12 tests | 8 | 6 |

TABLE 5

| | Electrical conductor wire | |
|---|---|---|
| | CuOF/Sn alloy B1 | CuOF/Sn alloy B2 |
| | Number of go-and-return 180° folds before the wire broke | |
| Test 1 | 10 | 7 |
| Test 2 | 8 | 7 |
| Test 3 | 9 | 6 |
| Test 4 | 10 | 7 |
| Test 5 | 7 | 7 |
| Test 6 | 9 | 6 |
| Test 7 | 9 | 6 |
| Test 8 | 8 | 6 |
| Test 9 | 10 | 7 |
| Test 10 | 10 | 6 |
| Test 11 | 9 | 6 |
| Test 12 | 9 | 6 |
| Number average over the 12 tests | 9 | 6 |

The number average obtained on the 12 electrical conductor wires (12 tests) of the invention (Cu/Sn alloy A1 and CuOF/Sn alloy B1) was greater than that obtained on the 12 prior art electrical conductor wires (Cu/Sn alloy A2 and CuOF/Sn alloy B2). Thus, the electrical conductor wire of the invention and the strand made therefrom is much better at withstanding mechanical stresses to which the wires are subjected while they are being manipulated, handled, transported, installed, or used.

Traction Strength Test

FIG. 1 shows breaking strength (MPa) or mechanical behavior as a function of tin content (% by weight):

of an electrical conductor wire having a diameter of 0.202 mm constituted by a Cu/Sn alloy having the oxygen and impurities content of the alloy A1 (curve labeled "single wire Cu+Sn"), and of a strand comprising an assembly of seven such wires (curve labeled "strand Cu+Sn"), and also of an electrical conductor wire having a diameter of 0.202 mm constituted by a CuOF/Sn alloy having the oxygen and impurities content of the alloy B1 (curve labeled "single wire CuOF+Sn"), and of a strand comprising an assembly of seven such wires (curve labeled "strand CuOF+Sn").

Both for curves concerning electrical conductor wires and for curves concerning strands, it can be seen that mechanical strength decreases significantly from 0.15% by weight (1500 ppm) of tin in the Cu/Sn for tin contents of less than 0.15% by weight, and from 0.07% to 0.08% by weight (700 ppm to 800 ppm) tin in the CuOF/Sn alloys for tin contents lower than 0.07% by weight.

What is claimed is:

1. A strand comprising:

one or more electrical conductor wires sized such that the strand has a total section of no more than 0.35 $mm^2$, wherein each electrical conductor wire is constituted by an alloy of copper and tin with:

a tin content of not less than 1500 ppm and not more than 2500 ppm;

an oxygen content of not more than 400 ppm;

an inevitable impurities content of not more than 100 ppm; and the balance of the content of said alloy being copper;

the electrical conductor wire(s) being exempt from heat treatment during fabrication of the strand.

2. The strand according to claim 1, wherein the tin content is strictly greater than 1500 ppm.

3. The strand according to claim 1, wherein the tin content is not less than 1700 ppm.

4. The strand according to claim 1, wherein the tin content is not more than 2200 ppm.

5. The strand according to claim 1, wherein the strand is not circularly compressed.

6. An electric cable including a strand as defined in claim 1, extending in the longitudinal direction of the cable, said strand being surrounded along the cable by an insulating sheath.

7. A cabling bundle comprising a plurality of electric cables according to claim 6.

8. The strand according 1, wherein the diameter of said one or more electrical conductor wires is in the range of 0.10 mm to 0.67 mm.

9. A strand comprising:

one or more electrical conductor wires sized such that the strand has a total section of no more than 0.35 $mm^2$, wherein each electrical conductor wire is constituted by an alloy of copper and tin with:

a tin content of not less than 700 ppm and not more than 1200 ppm;

an oxygen content of not greater than 50 ppm, an inevitable impurities content of not more than 100 ppm; and the balance of the content of said alloy being copper;

the electrical conductor wire(s) being exempt from heat treatment during fabrication of the strand.

10. An electric cable including a strand as defined in claims 9, extending in the longitudinal direction of the cable, said strand being surrounded along the cable by an insulating sheath.

11. A cabling bundle comprising a plurality of electric cables according to claim 10.

12. The strand according to claim 9, wherein the oxygen content is not greater than 5 ppm.

13. The strand according 9, wherein the diameter of said one or more electrical conductor wires is in the range of 0.10 mm to 0.67 mm.

* * * * *